United States Patent [19]

Rothman et al.

[11] Patent Number: 4,981,647

[45] **Date of Patent: * Jan. 1, 1991**

[54] NITROGEN STRENGTHENED FE-NI-CR ALLOY

[75] Inventors: Michael F. Rothman; Dwaine L. Klarstrom, both of Kokomo; George Y. Lai, Carmel, all of Ind.

[73] Assignee: Haynes International, Inc., Kokomo, Ind.

[ * ] Notice: The portion of the term of this patent subsequent to Aug. 1, 2006 has been disclaimed.

[21] Appl. No.: 385,585

[22] Filed: Jul. 26, 1989

Related U.S. Application Data

[63] Continuation-in-part of Ser. No. 154,606, Feb. 10, 1988, Pat. No. 4,853,185.

[51] Int. Cl.[5] ..... C22C 38/50; C22C 30/00

[52] U.S. Cl. ..... 420/584.1; 420/586; 420/586.1; 420/53; 420/51; 420/43

[58] Field of Search ..... 420/584, 585, 51, 43, 420/53, 586, 586.1

[56] References Cited

U.S. PATENT DOCUMENTS 4,853,185 8/1989 Rothman et al. ..... 420/584

FOREIGN PATENT DOCUMENTS 0154601 10/1984 European Pat. Off. .

1343735 1/1974 United Kingdom .

2117792 4/1982 United Kingdom .

2154611 6/1982 United Kingdom .

2138446 3/1983 United Kingdom .

*Primary Examiner*—Deborah Yee

*Attorney, Agent, or Firm*—Buchanan Ingersoll; Lynn J. Alstadt

[57] ABSTRACT

A corrosion resistant metal alloy having improved formability and workability is disclosed which alloy contains in weight percent about 25% to 45% nickel, about 12% to 32% chromium, of at least one of 0.1% to 2.0% columbium, 0.2% to 4.0% tantalum, and 0.05% to 1.0% vanadium, up to about 0.20% carbon, about 0.05% to 0.50% nitrogen, about 0.001% to 0.02% boron and the balance being iron plus impurities and wherein the carbon and nitrogen content are controlled so that the amount of free carbon and nitrogen defined as $$(C + N)_F = C + N - \frac{Cb}{9} - \frac{Ta}{18} - \frac{V}{4.5}$$

is greater than 0.14% and less than 0.29%. The alloy may also include in limited amounts one of aluminum, titanium, silicon, manganese, cobalt, molybdenum, tungsten, zirconium, yttrium, cerium and other rare earth metals.

17 Claims, No Drawings

NITROGEN STRENGTHENED FE-NI-CR ALLOY

REFERENCE TO RELATED APPLICATION

This is a continuation-in-part of our U.S. Patent Application Serial No. 154,606, now U.S. Pat. No. 4,853,185.

BACKGROUND OF THE INVENTION

This invention relates generally to metal alloys containing substantial amounts of iron, nickel and chromium and more particularly to a carefully balanced composition suitable for use in aggressive environments at high temperature.

DESCRIPTION OF THE PRIOR ART

Many people have attempted to develop alloys exhibiting high mechanical strength, low creep rates and good resistance to corrosion at various temperatures. In U.S. Pat. No. 3,627,516 Bellot and Hugo report that it was well known to make alloys having mechanical strength and corrosion resistance by including in the alloy about 30% to 35% nickel, 23% to 27% chromium and relatively low carbon, manganese, silicon, phosphorus and sulfur. Mechanical properties of this type of alloy were improved by adding tungsten and molybdenum. Bellot and Hugo further improved this alloy by adding niobium in a range of from 0.20% to 3.0% by weight. Two years later in U.S. Pat. No. 3,758,294 they taught that high mechanical strength, low creep rate and good corrosion resistance could be obtained in the same type of alloy by including 1.0% to 8.0% niobium, 0.3% to 4.5% tungsten and 0.02% to 0.25% nitrogen by weight. Both patents teach a carbon content of the alloy in the range 0.05% to 0.85%.

Bellot and Hugo appear to have no concern about the hot workability and fabricability of their alloys. It is well known that carbon contents in excess of 0.20% greatly impair hot workability and fabricability. Many of the alloys disclosed by Bellot and Hugo have more than 0.20% carbon. The claims of both their patents require about 0.40% carbon. Because of these high carbon levels such alloys are difficult to hot work, fabricate or repair.

In U.S. Pat. No. 3,627,516 Bellot and Hugo attempt to avoid the use of expensive alloying elements such as tungsten and molybdenum to improve mechanical properties by adding 0.20% to 3.0% niobium. But in U.S. Pat. No. 3,758,294 they later find that tungsten is required to achieve high weldability and easy resistance to carburization. Thus, the teaching of Bellot and Hugo is that tungsten although expensive is necessary to achieve high weldability in a corrosion resistant alloy.

Carbon and tungsten as well as other solid solution strengtheners such as molybdenum are used in alloys of the Ni-Cr-Fe family having generally about 15 to 45% nickel and 15 to 30% chromium to provide strength at high temperatures. The use of substantial amounts of carbon and solid solution strengtheners adversely affect thermal stability, reduce resistance to thermal cycling and usually raise the cost of the product excessively. Precipitation hardening is normally either limited to relatively low temperature strength improvements or has associated thermal stability and fabricability problems.

In addition to these strength considerations, prior art alloys of this family have only average corrosion resistance to aggressive high temperature environments such as those containing hydrocarbons, CO, $CO_2$ and sulfur compounds.

SUMMARY OF THE INVENTION

The present invention is a Fe-Ni-Cr alloy having improved mechanical properties and improved hot workability through the addition of a carefully controlled amount of nitrogen and the provision of nitrogen, columbium and carbon within a defined relationship. Boron in the range of 0.001% to 0.02% is added to improve creep strength of elevated temperatures. Preferably, columbium is added to comprise up to 1% of the alloy in order to produce complex carbonitride compound particles which form while the alloy is in service, and promote strengthening. Columbium also increases nitrogen solubility in the alloy, which allows for a higher level of nitrogen to be included in the alloy to yield higher strength. The presence of stronger nitride formers, such as aluminum and zirconium is limited to avoid excessive initial coarse nitride formation during alloy manufacture and consequent loss of strength. Chromium is present at levels over 12% to provide for both adequate oxidation resistance and adequate nitrogen solubility. In the presence of columbium, vanadium or tantalum in the alloy, a very small amount of titanium will have beneficial strengthening effects (not over 0.20% Ti). Silicon may be added up to 3.0% to optimize oxidation resistance, however, strength drops off markedly over about 1% Si. So two classes of alloy are possible: up to 1% Si has excellent strength and 1%–3% Si has lower strength but better oxidation resistance.

DESCRIPTION OF THE PREFERRED EMBODIMENT

The present alloy is a Fe-Ni-Cr alloy preferably having 25%–45% nickel and 12% to 32% chromium. More particularly the composition should fall within these ranges:

| | |
|---|---|
| Ni | 25% to 45% |
| Cr | 12% to 32% |
| Cb | 0.10 to 2.0% (min. 9 × carbon content) |
| Ti | Up to 0.20% max |
| Si | Up to 3% max |
| N | 0.05 to 0.50% |
| C | 0.02 to 0.20% |
| Mn | Up to 2.0% max |
| Al | Up to 1.0% max |
| Mo/W | Up to 5% max |
| B | 0.001% to 0.02% max |
| Zr | Up to 0.2 max |
| Co | Up to 5 max |
| Y, La, Ce, REM | Up to 0.1% max |
| and the balance iron and typical impurities | |

The nitrogen in this alloy acts as a solid solution strengthener and also precipitates as nitrides in service as a further strengthening mechanism. The prior art involves alloys with generally less than enough nickel to provide a stable austenitic matrix when subjected to long term thermal aging in service at elevated temperature. Nitrogen acts to stabilize austenitic structure, but if nickel is less than 25%, once nitrides are precipitated during service exposure at greater than 1000° F., the matrix is depleted in nitrogen, and alloys are prone to embrittlement from sigma phase precipitation. To avoid this, our alloys contain greater than 25% Ni, and preferably greater than 30% Ni.

It is known that titanium in the presence of nitrogen in an iron-base alloy will form undesirable, coarse titanium nitride particles. These nitrides form during alloy manufacture and contribute little towards elevated temperature strength in service. The exclusion of titanium from this type of alloy avoids depletion of nitrogen from the solid solution by the manner described, but does not provide optimum strengthening. We have found that in the presence of columbium, vanadium or tantalum in the alloy, a very small amount of titanium will have beneficial strenghtening effects as long as there is not more than 0.20% Ti. Consequently, we provide up to 0.20% titanium in our alloy. As those skilled in the art will recognize, columbium, vanadium or tantalum, which have a somewhat greater affinity for carbon than for nitrogen, can be added to this type of alloy to increase nitrogen solubility without depleting the majority of the nitrogen as coarse primary nitride or nitrogen-rich carbonitride particles. In excess of 2.0% columbium is undesirable because of a tendency to form deleterious phases such as $Fe_2Cb$ laves phase or $Ni_3Cb$ orthorhombic phase. For this reason, we provide a columbium to carbon ratio of at least 9 to 1 but generally less than 2.0%. Without columbium or an equivalent amount of vanadium or tantalum, the addition of nitrogen would not provide as much strength. To achieve similar results, half the weight in vanadium or double the weight in tantalum should be used whenever they are substituted for columbium.

Silicon may be added up to 3.0% to optimize oxidation resistance. However, strength drops off markedly over about 1% Si. Thus, one can use up to 1% Si for excellent strength or provide 1%–3% Si to obtain lower strength but better oxidation resistance. Strong nitride formers, such as aluminum and zirconium, are limited to avoid excessive coarse nitride formation during alloy manufacture, and consequent loss of strength in service. Chromium is present at levels over 12% to provide for both adequate oxidation resistance and adequate nitrogen solubility.

EXAMPLE I

To determine the influence of columbium in this alloy, we prepared an alloy having a nominal composition of 33% Ni, 21% Cr, 0.7% Mn, 0.5% Si, 0.3% Al, plus carbon, nitrogen, titanium and columbium as set forth in Table I and the balance iron. These alloys were tested to determine the time required for one percent creep under three temperature and stress conditions. The results of that test are set forth in Table 1.

This data indicates that Ti ties up N in preference to carbon, forming TiN with possibly some Ti (C, N). Cb ties up C in preference to N, so as long as C/Cb ratio stays relatively constant, N is available to form strengthening $Cr_2N$ and CbN precipitates, or to provide solid solution strengthening. So the strength levels exhibited by alloys C, D and E are nearly the same. Note that adding nitrogen to replace carbon by more than 2:1 without Cb does little to improve strength, as evidenced by alloys A and F versus alloy E. Also, simply adding Cb to alloy containing Ti does not significantly improve strength, as evidenced by comparing alloy G to alloy A. Finally, the alloys with titanium levels at 0.40 and 0.45 performed poorly suggesting that such high titanium levels are detrimental.

TABLE 1

Cb vs Ti
Nominal (%): Fe-33% Ni-21% Cr-0.7% Mn-0.5% Si-0.3% Al

| | % Other Elements | | | | Time to 1% Creep (Hours for Two Samples) | | |
|---|---|---|---|---|---|---|---|
| Alloy | C | N | Ti | Cb | 1400° F./ 13 ksi | 1500° F./ 10 ksi | 1600° F./ 7 ksi |
| A | .07 | .01 | .40 | .05 | 1, 1 | 1, 1 | 1, 2 |
| B | .06 | .20 | .31 | .05 | 4, 5 | — | — |
| C | .05 | .20 | + | .46 | 12, 18 | 9, 10 | 34, 55 |
| D | .09 | .19 | + | 1.00 | 13, 15 | 7, 8 | 34, 41 |
| E | .02 | .19 | + | .26 | 7, 14 | 9, 11 | 32, 32 |
| F | .01 | .19 | + | .05 | 2, 4 | 1, 2 | 8, 10 |
| G | .08 | .04 | .45 | .48 | — | 1, 2 | 2, 5 |

+ means less than 0.01%

EXAMPLE II

The effect of nitrogen and carbon is revealed in tests of several alloys having the same nickel, chromium, manganese, silicon and aluminum content as the iron-base alloys of Example I and carbon, nitrogen, titanium and columbium content set forth in Table 2 and Table 2A.

The data in Table 2 demonstrates that strength goes up with increasing (C+N). Greater than 0.14% "free" (C+N) is necessary for good high temperature strength. At a columbium level of 0.20%, a carbon level of 0.05% and a nitrogen content of 0.02% (the minimum values taught by Bellot and Hugo), the "free" (C+N) =0.05% which is not adequate for good strength. To obtain the needed minimum of 0.14% "free" (C+N) with carbon at 0.05% at least 0.11% nitrogen is required. At a columbium level of 0.50% and carbon level of 0.05%, nitrogen greater than 0.15% is required to obtain "free" (C+N) above 0.14%. If carbon is increased to 0.10% with the same columbium content, then more than 0.10% nitrogen is still required to obtain the desired level of "free" (C+N). Finally, at a third level of columbium of 1.0% we still see a relationship between carbon and nitrogen. With carbon at 0.05%, nitrogen greater than .20% is required for free (C+N) to be above 0.14%. At C =0.10% then N greater than 0.15% is required. And, at C =0.15% then N greater than 0.10% is required. Consequently, to achieve acceptable strength levels (C+N) must be greater than 0.14%

$$\frac{Cb}{9}.$$

Table 2A shows that thermal of high (C+N) level compositions can be poor. In order to maintain adequate stability, "free" (C+N) should be less than 0.29%. Therefore, (C+N) must be less than 0.29%

$$\frac{Cb}{9}.$$

Thus, the critical ranges of (C+N) at four levels of Cb are as follows:

| Cb (%) | (C + N) min. (%) | (C + N) max. (%) |
|---|---|---|
| 0.25 | 0.17 | 0.32 |
| 0.50 | 0.20 | 0.35 |
| 0.75 | 0.22 | 0.37 |
| 1.00 | 0.25 | 0.40 |

TABLE 2

Effect of (C + N) & "Free" (C + N) on Strength

| Heat | C | N | Cb | Ti | C + N | Free (C + N)* | Hours to 1% Creep 1600° F./7 ksi |
|---|---|---|---|---|---|---|---|
| 7984-1 | .08 | .08 | .47 | .07 | .16 | .09 | 12 |
| 20883 | .04 | .12 | .48 | + | .16 | .10 | 8 |
| 21283 | .09 | .14 | .98 | + | .23 | .12 | 9 |
| 7483 | .08 | .14 | .51 | .17 | .22 | .11 | 19 |
| 5785 | .08 | .14 | .51 | .07 | .22 | .14 | 25 |
| 5485 | .06 | .18 | .52 | .08 | .24 | .16 | 33 |
| 8784 | .07 | .16 | .49 | .05 | .23 | .16 | 40 |
| 8284 | .08 | .16 | .48 | .02 | .24 | .18 | 35 |
| 8884 | .09 | .27 | .51 | .07 | .36 | .28 | 88 |
| 8984 | .09 | .40 | .50 | .05 | .49 | .42 | 94 |

+ less than 0.01%

$$*\text{Free (C + N)} = \left[C - \frac{Cb}{9}\right] + \left[N - \frac{Ti}{3.5}\right]$$

TABLE 2A

Effect of (C + N) & "Free" (C + N) on Thermal Stability

| Heat | C | N | Cb | Ti | C + N | Free (C + N)* | Exposure at 1400° F./1000 Hrs. Residual RT Tensile El (%) |
|---|---|---|---|---|---|---|---|
| 22584 | .08 | .04 | .48 | .45 | .12 | .00 | 40 |
| 984-2 | .05 | .07 | .48 | .20 | .12 | .01 | 38 |
| 7984-1 | .08 | .08 | .47 | .07 | .16 | .09 | 34 |
| 7483 | .08 | .14 | .51 | .17 | .22 | .11 | 29 |
| 5785 | .08 | .14 | .51 | .07 | .22 | .14 | 32 |
| 5485 | .06 | .18 | .52 | .08 | .24 | .16 | 32 |
| 8784 | .07 | .16 | .49 | .05 | .23 | .16 | 24 |
| 8284 | .08 | .16 | .48 | .02 | .24 | .18 | 24 |
| 8884 | .09 | .27 | .51 | .07 | .36 | .28 | 25 |
| 5885 | .08 | .29 | .49 | .08 | .37 | .29 | 11 |
| 8984 | .09 | .40 | .50 | .05 | .49 | .42 | 14 |

$$*\text{Free (C + N)} = \left[C - \frac{Cb}{9}\right] + \left[N - \frac{Ti}{3.5}\right]$$

EXAMPLE III

The criticality of titanium can be seen from creep data for alloys I, K, L and M which have similar base materials as the other alloys tested. The creep data for those alloys tested at 1400° F. and 13 ksi are shown in Table 3. In that table the alloys are listed in order of increasing titanium content. This data indicates that any titanium is beneficial. However, the data from Table I indicates an upper titanium limit of not more than 0.40%.

TABLE 3

Ti Criticality
Nominal (%): Fe-33% Ni-21% Cr-0.7% Mn-0.5% Si-0.3% Al-005% B

| Alloy | % Other Elements C | N | Ti | Cb | Average Hours to 1% Creep at 1400° F./13ksi (Hours) |
|---|---|---|---|---|---|
| K | .08 | .18 | Nil | .49 | 35 |
| L | .08 | .16 | .02 | .48 | 47 |
| I | .08 | .14 | .07 | .51 | 92 |
| M | .08 | .14 | .17 | .51 | 59 |

EXAMPLE IV

Silicon is an important component of the alloy. Its influence is shown in Table 4. The data in that table indicates that silicon must be carefully controlled to achieve optimum properties. Low levels of silicon are fine. However, when silicon levels reach and exceed about 2% performance drops sharply. This is apparently caused by silicon nitride which has formed in increasing amounts as the silicon level increases.

TABLE 4

Si Criticality
Nominal (%): Fe-33% Ni-21% Cr-0.7% Mn-0.5% Si-0.3% Al-0.005% B

| Alloy | % Other Elements C | N | Ti | Si | Time to 1% Creep (Hours) 1400° F./13 ksi 1% | R | 1600° F./7 ksi 1% | R | 1800° F./2.5 ksi 1% | R |
|---|---|---|---|---|---|---|---|---|---|---|
| I | .08 | .14 | .07 | .57 | 81 | 951 | 23 | 179 | 43 | 160 |
| | | | | | 104 | 948 | 27 | 214 | 160 | 402 |
| N | .07 | .12 | .02 | 1.40 | 61 | 592 | 25 | 321 | 216 | 672 |
| | | | | | 40 | 640 | 10 | 227 | | |
| O | .08 | .15 | .06 | 1.96 | 3 | 73 | 3 | 58 | 112 | 315 |
| | | | | | 4 | 79 | 4 | 56 | 206 | 547 |
| P | .08 | .14 | .08 | 2.41 | 4 | 55 | 2 | 47 | 138 | 470 |
| | | | | | 2 | 49 | 2 | 48 | 137 | 512 |

EXAMPLE V

The data shown in Table 5 reveals that the presence of zirconium at 0.02% dramatically reduces creep time. Also, as aluminum content approaches 1.0% it produces a similar result.

TABLE 5

Adverse Effects of Al & Zr
Nominal (%): Fe-33% Ni-21% Cr-0.5% Cb-0.7% Mn-005% B

| Alloy | % Other Elements C | N | Si | Al | Zr | Average Hours to 1% Creep at 1400° F./13 ksi (Hours) |
|---|---|---|---|---|---|---|
| Q | .08 | .14 | .60 | .24 | Nil | 59 |
| R | .08 | .14 | .61 | .86 | Nil | 13 |
| S | .07 | .12 | 1.40 | .28 | Nil | 49 |
| T | .07 | .21 | 1.48 | .28 | .02 | 7 |

Based upon the data from Tables 1 through 5, we selected alloys I and two other alloys, U and V, and provide creep data in Table 6.

Alloys I and V compare favorably to prior art alloys in mechanical properties as shown in Tables 7, 8 and 9.

TABLE 6

Cb vs Ti
Nominal (%): Fe-0.5% Cb-0.7% Mn-0.5% Si-0.3% Al-0.005% B

| Alloy | % Other Elements Ni | Cr | C | N | Time to 1% Creep (Hours) 1400° F./13 ksi | 1600° F./7 ksi | 1800° F./2.5 ksi |
|---|---|---|---|---|---|---|---|
| I | 34.0 | 20.8 | .08 | .14 | 92 | 25 | 83 |
| U | 40.3 | 20.9 | .06 | .18 | 60 | 33 | 119 |
| V | 39.8 | 30.0 | .07 | .16 | 77 | 40 | 274 |

TABLE 7

COMPARATIVE PROPERTIES (Sheet)

| | Alloy I | Alloy V | 800H | 253MA | 601 | 310 | 316 |
|---|---|---|---|---|---|---|---|
| Yield Strength (ksi) | | | | | | | |
| RT | 41 | 49 | 35 | 51 | 42 | 32 | |
| 1,200° F. | 26 | 27 | 22 | 24 | 38 | 17 | 21 |
| 1,400° F. | 24 | 28 | 20 | 22 | 39 | 15 | 18 |
| 1,600° F. | 20 | 25 | 13 | 16 | 16 | 12 | 11 |
| 1,800° F. | 11 | 10 | 8 | — | 9 | 6 | 6 |
| Tensile Elongation (%) | | | | | | | |
| RT | 42 | 45 | 46 | 51 | 47 | 46 | — |
| 1,200° F. | 42 | 50 | 45 | 48 | 50 | 39 | — |
| 1,400° F. | 45 | 40 | 62 | 44 | 41 | 73 | — |

TABLE 7-continued

| | COMPARATIVE PROPERTIES (Sheet) | | | | | | |
|---|---|---|---|---|---|---|---|
| | Alloy I | Alloy V | 800H | 253MA | 601 | 310 | 316 |
| 1,600° F. | 61 | 35 | 56 | — | 65 | 69 | — |
| 1,800° F. | 56 | 66 | 83 | — | 86 | 54 | — |

TABLE 8

| Exposure Temperature | | COMPARATIVE PROPERTIES (Sheet) Room Temperature Properties After 1,000 Hours at Temperature | | | | |
|---|---|---|---|---|---|---|
| | | Alloyl I | Alloyl V | 800H | 601 | 310 |
| 1,200° F. | UTS | 98 | 16 | 88 | 127 | 86 |
| | YS | 41 | 57 | 38 | 76 | 37 |
| | EL | 35 | 30 | 38 | 31 | 41 |
| 1,400° F. | UTS | 94 | 121 | 83 | 106 | 100 |
| | YS | 39 | 62 | 34 | 51 | 41 |
| | EL | 32 | 24 | 41 | 37 | 21 |
| 1,600° F. | UTS | 90 | 108 | 78 | 91 | 84 |
| | YS | 35 | 48 | 30 | 38 | 35 |
| | EL | 33 | 32 | 39 | 45 | 23 |
| As Annealed | UTS | 99 | 108 | 82 | 95 | 81 |
| | YS | 41 | 49 | 36 | 42 | 32 |
| | EL | 42 | 45 | 46 | 47 | 46 |

TABLE 9

| | COMPARATIVE PROPERTIES (Sheet) | | | | | | |
|---|---|---|---|---|---|---|---|
| | ALLOY I | ALLOY V | 800H | 253MA | 601 | 310 | 316 |
| Stress Rupture Life (Hours) | | | | | | | |
| 1,400° F./13 ksi | 949 | 551 | 104 | 110 | 205 | 10 | 95 |
| 1,600° F./7 ksi | 196 | 194 | 88 | 40 | 98 | 5 | — |
| Creep Life (Hours to 1%) | | | | | | | |
| 1,400° F./13 ksi | 92 | 77 | 3 | 18 | 46 | 1 | — |
| 1,600° F./7 ksi | 25 | 40 | 8 | 10 | 29 | 1 | — |

From the data discussed above, we have found that an alloy comprised of 25 to 45% nickel, about 12% to 32% chromium, at least one of 0.1% to 2.0% columbium, 0.2% to 4.0% tantalum and 0.05% to 1.0% vanadium, up to about 0.20% carbon, and about 0.05% to 0.50% nitrogen with the balance being iron plus impurities has good hot workability and fabricability characteristics provided $(C+N)_F$ is greater than 0.14% and less than 0.29%. As previously stated $$(C + N)_F = C + N - \frac{Cb}{9}.$$

In versions of the alloy wherein vanadium and tantalum are substituted separately or in combination for all or part of the columbium $(C+N)_F$ is defined by $$C + N - \frac{Cb}{9} - \frac{V}{4.5} - \frac{Ta}{18}.$$

Boron content of 0.001% to 0.2% will improve creep strength, but higher levels will impair weldability markedly.

Silicon may be added to the alloy but preferably it does not exceed 3% by weight. Up to 1% silicon has excellent strength while 1% to 3% silicon has lower strength but better oxidation resistance. Titanium may also be added to improve creep resistance. However, not more than 0.20% titanium should be used. Manganese and aluminum may be added basically to enhance environment resistance, but should generally be limited to less than 2.0% and 1.0% respectively.

Molybdenum, tungsten and cobalt may be added in moderate amounts to further enhance strength at elevated temperatures. Molybdenum and tungsten will provide additional strength without significant thermal stability debit up to about 5%. Higher levels will produce some measurable loss in thermal stability, but can provide significant further strengthening up to a combined content of about 12%.

While we have described certain present preferred embodiments of our invention, it is to be distinctly understood that the invention is not limited thereto but may be variously embodied within the scope of the following claims.

We claim:

1. A metal alloy comprised of, in weight percent, about 25% to 45% nickel, about 12% to 32% chromium, at least one of 0.1% to 2.0% columbium, 0.2% to 4.0% tantalum and 0.05% to 1.0% vanadium, up to about 0.20% carbon, about 0.05% to 0.50% nitrogen, about 0.001% to 0.02% boron and the balance being iron plus impurities and wherein $(C+N)_F$ is greater than 0.14% and less than 0.29% $(C+N)_F$ being defined as $$(C + N)_F = C + N - \frac{Cb}{9} - \frac{V}{4.5} - \frac{Ta}{18}.$$

2. The alloy of claim 1 further including at least one of up to 1% aluminum, up to 0.2% titanium, up to 3% silicon, up to 2% manganese, up to 5% cobalt, up to 5% total molybdenum and tungsten, up to 0.2% zirconium, and up to 0.1% total yttrium, lanthanum, cerium and other rare earth metals.

3. The alloy of claim 1 containing about 30% to 42% nickel, about 20% to 32% chromium, one of columbium 0.2% to 1.0%, 0.2% to 4.0% tantalum and 0.05% to 1.0% vanadium, about 0.02% to 0.15% carbon.

4. The alloy of claim 3 further comprising at least one of up to 1% aluminum, up to 3% silicon, up to 2% manganese, up to 0.2% zirconium, up to 5.0% cobalt, up to 2.0% total molybdenum plus tungsten and up to 0.1% total yttrium, lanthanum, cerium and other rare earth metals.

5. The alloy of claim 3 also comprising an effective addition of titanium up to 0.20% to provide beneficial strengthening effects at elevated temperatures.

6. The alloy of claim 3 also comprising molybdenum and tungsten at a combined weight percent in the range of 2.0% to 12%.

7. The alloy of claim 3 also comprising at least one of up to 0.5% aluminum, up to 0.1% titanium, 0.25% to 1.0% silicon, 0.35% to 1.2% manganese, up to 0.015% boron and up to 0.1% total yttrium, lanthanum, cerium and other rare earth metals.

8. The alloy of claim 3 also comprising from about 1.0% to 3.0% silicon.

9. The alloy of claim 1 also comprising molybdenum and tungsten at a combined weight percent in the range of 2.0% to 12%.

10. The alloy of claim 1 also comprising from about 1.0% to 3.0% silicon.

11. The alloy of claim 1 also comprising from about 0.25% to 1.0% silicon.

12. The alloy of claim 1 produced as a casting.

13. A metal alloy comprised of in weight percent about 30% to 42% nickel, about 20% to 32% chromium, at least one of 0.2% to 1.0% columbium, 0.2% to 4.0% tantalum, and 0.05% to 1.0% vanadium, up to 0.2% carbon, about 0.05% to 0.50% nitrogen, about 0.001% to 0.02% boron, up to 0.2% titanium and the balance being iron plus impurities wherein $(C+N)_F$ is greater than 0.14% and less than 0.29%, $(C+N)_F$ being defined as $$(C + N)_F = C - \frac{Cb}{9} - \frac{V}{4.5} - \frac{Ta}{18} + N - \frac{Ti}{3.5}.$$

14. The alloy of claim 13 further comprising at least one of up to 1% aluminum, up to 3% silicon, up to 2% magnesium, up to 0.2% zirconium, up to 5.0% cobalt, up to 2.0% total molybdenum plus tungsten and up to 0.1% total yttrium, lanthanum, cerium and other rare earth metals.

15. The alloy of claim 13 also comprising molybdenum and tungsten at a combined weight percent in the range of 2.0% to 12%.

16. The alloy of claim 13 also comprising at least one of up to 0.5% aluminum, up to 0.1% titanium, 0.25% to 1.0% silicon, 0.35% to 1.2% manganese, and up to 0.1% total yttrium, lanthanum, cerium and other rare earth metals.

17. The alloy of claim 13 also comprising from about 1.0% to 3.0% silicon.

* * * * *

UNITED STATES PATENT AND TRADEMARK OFFICE

CERTIFICATE OF CORRECTION

PATENT NO. : 4,981,647

DATED : January 1, 1991

INVENTOR(S) : MICHAEL F. ROTHMAN, DWAINE L. KLARSTROM, GEORGE Y. LAI

It is certified that error appears in the above-identified patent and that said Letters Patent is hereby corrected as shown below:

Column 6, Table 7, under the column "316", delete the first blank and insert --38--.

Column 7, Table 9, under the column "316", under 95 delete the "-" and insert --21--.

Signed and Sealed this

Second Day of June, 1992

*Attest:*

*Attesting Officer*

DOUGLAS B. COMER

*Acting Commissioner of Patents and Trademarks*